United States Patent [19]

Glang et al.

[11] Patent Number: 4,900,607

[45] Date of Patent: Feb. 13, 1990

[54] SEALING PROFILE

[75] Inventors: Siegfried Glang, Hamburg; Werner Grabe, Winsen/Luhe, both of Fed. Rep. of Germany

[73] Assignee: Phoenix Aktiengesellschaft, Hamburg, Fed. Rep. of Germany

[21] Appl. No.: 238,723

[22] Filed: Aug. 30, 1988

[30] Foreign Application Priority Data

Sep. 5, 1987 [DE] Fed. Rep. of Germany ..... 3729794
Apr. 16, 1988 [DE] Fed. Rep. of Germany ..... 3812751

[51] Int. Cl.[4] ..... B32B 3/10; E21D 11/00

[52] U.S. Cl. ..... 428/131; 428/137; 428/156; 428/167; 428/134; 428/172; 428/178; 428/179; 428/192; 428/492; 52/396; 52/403; 277/205; 277/207 R; 277/208; 404/37; 405/135; 405/152

[58] Field of Search ..... 428/57, 58, 72, 167, 428/188, 192, 492, 131, 134, 137, 156, 172, 178, 179; 49/475; 52/393, 396, 403; 277/205, 206 A, 206 R, 207 A, 207 R, 208, 209, 211; 404/37, 47, 64, 65, 66, 68, 69; 405/134, 135, 150, 151, 152, 153, 146, 147

[56] References Cited

U.S. PATENT DOCUMENTS

| | | | |
|---|---|---|---|
| 4,199,158 | 4/1980 | de Munck | 405/135 |
| 4,671,028 | 6/1987 | Figone | 428/188 |
| 4,762,441 | 8/1988 | Glang | 405/135 |
| 4,797,032 | 1/1989 | Glang | 405/152 |

FOREIGN PATENT DOCUMENTS

| | | | |
|---|---|---|---|
| 2833345 | 2/1980 | Fed. Rep. of Germany | 405/152 |
| 3008711 | 9/1981 | Fed. Rep. of Germany | 405/152 |
| 2513365 | 1/1977 | Netherlands | 405/152 |
| 2121457 | 12/1983 | United Kingdom | 405/152 |
| 2178114 | 2/1987 | United Kingdom | 405/152 |
| 2193541 | 2/1988 | United Kingdom | 405/152 |

*Primary Examiner*—Ellis P. Robinson
*Assistant Examiner*—Donald J. Loney
*Attorney, Agent, or Firm*—Collard, Roe & Galgano

[57] ABSTRACT

A sealing profile formed of rubber or rubber-like material is provided for sealing tunnel segments which have circumferential recesses. There is a plurality of slotted grooves running parallel in the lengthwise direction on the base side of the profile and a plurality of channels running parallel in the lengthwise direction, the number of channels being no greater than the number of slotted grooves and at least one channel being in alignment with a corresponding groove.

14 Claims, 3 Drawing Sheets

SEALING PROFILE

The present invention relates to a sealing profile for sealing tunnel segments which are provided with a circumferential recess.

Sealing frames for concrete, steel, reinforced concrete or cast iron segments generally consist of four composite sealing profiles or profile strips, wherein the frame corners are preferably produced by the injection molding process. The sealing profiles themselves feature, at least in the lengthwise direction, parallel slotted grooves (see DE-U-72 03 419, DE-U-72 29 665, DE-U-74 32 945, DE-C-25 13 365). Particularly effective in relation to their sealing function are profile strips featuring parallel slotted grooves and channels in the lengthwise direction (see DE-C-28 33 345, DE-A-35 02 620, EP-A-0 210 326). Of particular significance in the construction of tunnels is the tubing system with its special configuration of segments. Often, it suffices for a segment to have just one sealing frame, but under special circumstances, it may prove necessary to provide each segment with a double sealing frame.

More and more frequently, large tunnel projects are being undertaken at extreme depths. At this time, a rail link between France and Great Britain is in its initial stages. At its deepest point, the tunnel tubes will lie a hundred meters below the surface of the sea. Other projects of this nature are being contemplated. Such projects are dependent on the elastomer profiles for sealing the segments having long life and absolutely safe sealing function even in the presence of severe misalignment of the segments.

The object of the present invention is to provide a sealing profile for sealing tunnel segments adapted to meet the most rigorous requirements.

The above object is accomplished in accordance with the present invention by providing a sealing profile having parallel grooves and parallel channels both running in the longitudinal direction, the number of channels being the same as or less than the number of grooves, and at least some of the channels being aligned with the grooves. Heretofore, the basic consideration has been that the channels must be arranged at an offset to the slotted grooves in order to achieve proper sealing action of the sealing profiles. With the arrangement of the channels consistent with the present invention and for either one of the profiles where the number of grooves is two or more and the number of channels is the same and where the number of grooves is four or more and the number of channels is less, this assumption is unexpectedly refuted.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

BRIEF DESCRIPTION OF THE DRAWING

Turning to FIG. 1 of the drawings, the object is to seal a longitudinal of transverse joint 1 of adjoining tunnel segments 2 and 3. To this end, sealing profiles 6 and 7 made of rubber or rubber-like material are inserted into recesses 4 and 5 of segments 2 and 3, respectively. Each of the counteropposed sealing profiles features two arch-shaped slotted grooves 8 and 9 on the base side of the profile. Both slotted grooves are surmounted without any offset by two channels 10 and 11 which have a circular shape when viewed in cross section. Because of this special configuration, even a relatively small sealing profile will achieve an elevated sealing action, and this even when the segments are misaligned by the amount X.

In FIG. 2, two counteropposed sealing profiles 12 and 13 are illustrated, each featuring three arch-shaped slotted grooves 14, 15 and 16. Of the three channels having an oval shape when viewed in cross section, designated 17, 18 and 19, the one in the middle, designated 18, lies directly, i.e., without offset, over center groove 15. The two outer channels 17 and 19 are slightly offset towards the center of the profile.

In FIG. 3, a sealing profile, designated 20, is illustrated with four arch-shaped slotted grooves 21, 22, 23 and 24 and four channels, designated 25, 26, 27 and 28, having a semi-circular shape when viewed in cross section, which are arranged directly over, or aligned with, the slotted grooves. The arch-shaped portions of the channels face back 29 of the profile.

Figure 4:
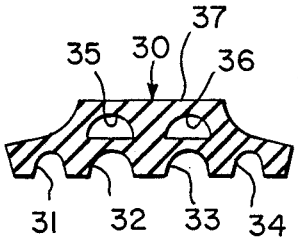
FIG. 4 is a cross-sectional view of a sealing profile according to a second type embodiment.

A sealing profile 30 is shown in FIG. 4 and also features four arch-shaped slotted grooves 31, 32, 33 and 34, wherein only the two middle grooves 32 and 33 have channels 35 and 36, having a semicircular shape when viewed in cross section, aligned therewith. Once again, the arch-shaped portion of the channels faces the back of profile 37. In this case, the two outer grooves 31 and 34 are not as wide as the two middle ones 32 and 33.

Figure 1:
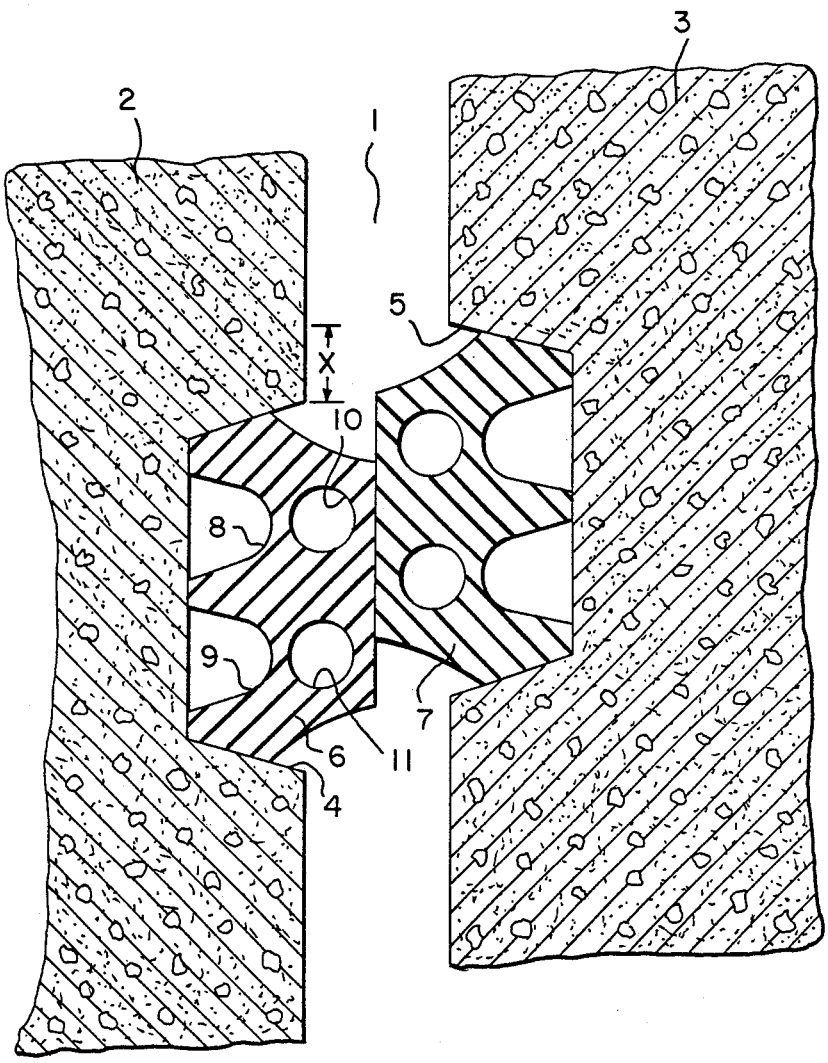
FIG. 1 is a cross-sectional view of two adjoining tunnel segments, having counteropposed sealing profiles according to a first type embodiment.
Figure 2:
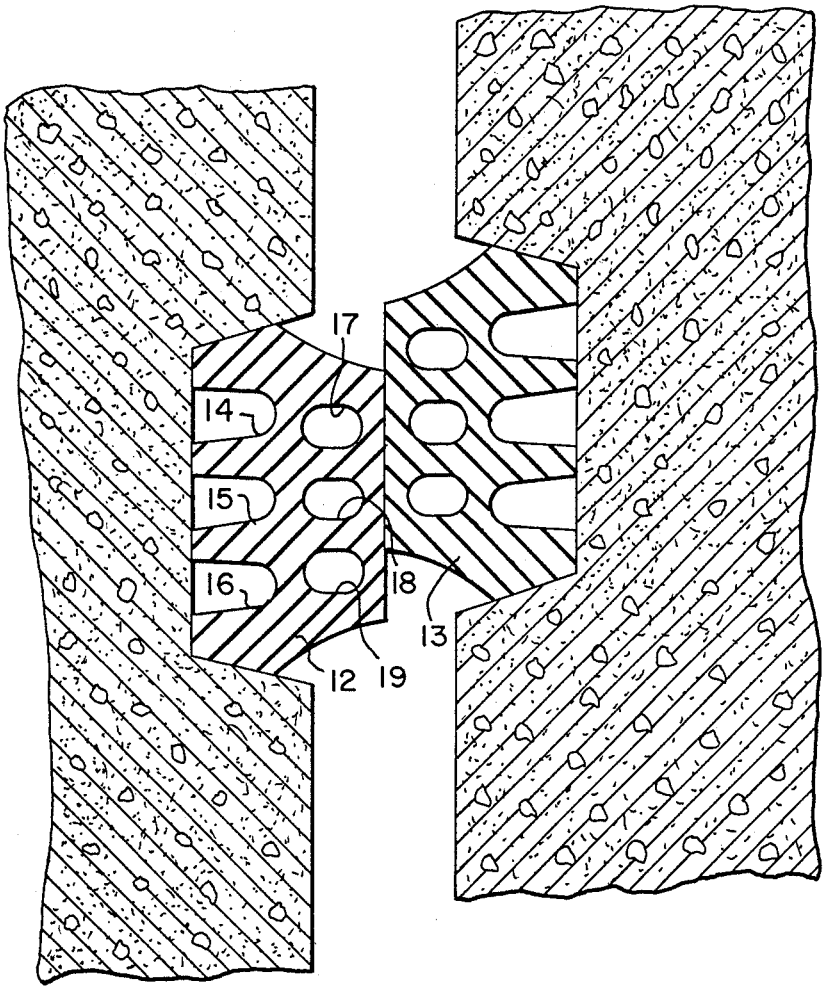
FIG. 2 is a cross-sectional view similar to that of FIG. 1, having an alternative first type sealing profile embodiment.
Figure 3:
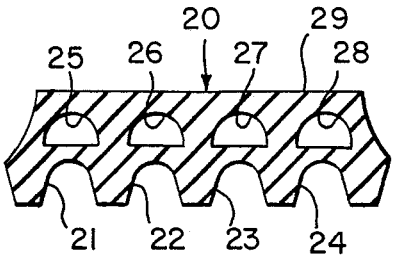
FIG. 3 is a cross-sectional view of a sealing profile of yet another first type embodiment.

In each of the sealing profiles illustrated herein, the channels possess a single basic geometry, for example semicircular, however, a combination of different shapes is also feasible. Thus, for example, outer channels 25 and 28 of sealing profile 20 shown in FIG. 3 may be circular in shape when viewed in cross section.

While several embodiments of the present invention have been shown and described, it will be obvious that many changes and modifications may be made thereunto without departing from the spirit and scope of the invention.

What is claimed is:

1. A sealing profile formed of an elastomeric material for sealing tunnel segments which have a circumferential recess, said sealing profile comprising:

(a) a base side adapted to be accepted in the recesses of said tunnel and a profile body;

(b) a plurality of slotted parallel grooves running in the lengthwise direction on the base side of said sealing profile; and (c) a plurality of parallel channels spaced from said parallel grooves and arranged in a plane substantially parallel to the base side of the sealing profile and running in the lengthwise direction in said profile body, the number of channels being no greater than the number of grooves and at least one of said plurality of channels being in alignment with a corresponding groove.

2. The sealing profile according to claim 1, wherein the number of grooves is at least two and the number of channels are equal to the number of grooves.

3. The sealing profile according to claim 1, wherein the number of grooves is at least four and the number of channels are less than the number of grooves.

4. The sealing profile according to claim 1, wherein the cross-sectional shape of the channels is circular.

5. The sealing profile according to claim 1, wherein the cross-sectional shape of the channels is oval.

6. The sealing profile according to claim 1, wherein the cross-sectional shape of the channels is semicircular.

7. The sealing profile according to claim 6, wherein the arch-shaped portion of the semicircular channels faces the back of the profile.

8. The sealing profile according to claim 1, wherein the number of channels is equal to the number of grooves which is two to six.

9. The sealing profile according to claim 8, wherein there are two slotted grooves and two channels which appear circular when viewed in cross-section.

10. The sealing profile according to claim 8, wherein there are three slotted grooves and three oval-shaped channels as viewed in cross-section, and the outer channels are slightly offset towards the center of the profile.

11. The sealing profile according to claim 8, wherein there are four slotted grooves and four semicircular channels as viewed in cross-section, and the arch-shaped portion of said channels face the back of the profile.

12. The sealing profile according to claim 3, wherein the number of channels is two less than the number of grooves and the number of grooves is four to six.

13. The sealing profile according to claim 12, wherein no channels are aligned with the two outer slotted grooves.

14. The sealing profile according to claim 13, wherein there are four slotted grooves and two semi-circular channels, and the arch-shaped part of the channels face the back of the profile.

* * * * *